US010556429B2

(12) United States Patent
Nakagawa

(10) Patent No.: US 10,556,429 B2
(45) Date of Patent: Feb. 11, 2020

(54) PRINT ELEMENT SUBSTRATE AND LIQUID EJECTION HEAD

(71) Applicant: CANON KABUSHIKI KAISHA, Tokyo (JP)

(72) Inventor: Yoshiyuki Nakagawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/207,926

(22) Filed: Dec. 3, 2018

(65) Prior Publication Data

US 2019/0100004 A1 Apr. 4, 2019

Related U.S. Application Data

(62) Division of application No. 15/429,546, filed on Feb. 10, 2017, now Pat. No. 10,150,291.

(30) Foreign Application Priority Data

Feb. 19, 2016 (JP) ..... 2016-030137

(51) Int. Cl.

| | |
|---|---|
| ***B41J 2/14*** | (2006.01) |
| ***B41J 2/18*** | (2006.01) |
| ***B41J 2/175*** | (2006.01) |

(52) U.S. Cl.

CPC ..... *B41J 2/14032* (2013.01); *B41J 2/1404* (2013.01); *B41J 2/14145* (2013.01); *B41J 2/17563* (2013.01); *B41J 2/18* (2013.01); *B41J 2002/14403* (2013.01); *B41J 2002/14459* (2013.01); *B41J 2002/14467* (2013.01); *B41J 2202/12* (2013.01)

(58) Field of Classification Search

CPC .. B41J 2/14032; B41J 2/14145; B41J 2/1404; B41J 2002/14459; B41J 2002/12; B41J 2002/14467

See application file for complete search history.

(56) References Cited

U.S. PATENT DOCUMENTS

| | | | |
|---|---|---|---|
| 8,454,131 | B2 | 6/2013 | Murakami et al. |
| 8,573,758 | B2 | 11/2013 | Inoue et al. |
| 2008/0246813 | A1 | 10/2008 | Murakami et al. |
| 2010/0208010 | A1 | 8/2010 | Inoue et al. |
| 2012/0056940 | A1 | 3/2012 | Sakurai et al. |

FOREIGN PATENT DOCUMENTS

| | | | |
|---|---|---|---|
| JP | 2008-254304 | A | 10/2008 |
| JP | 2010-188572 | A | 9/2010 |
| WO | 2015/163069 | A1 | 10/2015 |

*Primary Examiner* — Julian D Huffman

(74) *Attorney, Agent, or Firm* — Venable LLP

(57) ABSTRACT

Provided is an inkjet print head capable of favorably cleaning an ejection port surface and also of improving landing accuracy of ejected ink onto a print medium. For that purpose, a conductive layer formed of a conductive material is formed on a support substrate, flattening processing is executed, and a liquid ejection substrate is mounted on the support substrate with good positional accuracy without protrusion of a sealant for protecting an electric connection portion of the liquid ejection substrate from the ejection port surface.

6 Claims, 8 Drawing Sheets

PRINT ELEMENT SUBSTRATE AND LIQUID EJECTION HEAD

The present application is a divisional of U.S. patent application Ser. No. 15/429,546, filed Feb. 10, 2017, which claims priority to JP 2016-030137, filed Feb. 19, 2016, the entire disclosure of each of which is incorporated by reference herein.

BACKGROUND OF THE INVENTION

Field of the Invention

The present invention relates to a print element substrate, a liquid ejection head, and a liquid ejecting device which eject ink supplied through a channel and specifically to arrangement of an ejection port array in the print element substrate.

Description of the Related Art

Arrangement of the ejection port array in the print element substrate constituting the liquid ejection head includes one in which the ejection port array is arranged between paths for supplying ink/causing ink to flow out (Japanese Patent Laid-Open No. 2010-188572). In the liquid ejection head with this alignment, ejection energy is applied to the ink supplied to a pressure chamber through the path, and thus the ink is ejected from the ejection port communicating with the pressure chamber to perform printing.

As in Japanese Patent Laid-Open No. 2010-188572, with arrangement configuration in which one ejection port array is formed between paths for supplying the ink/causing the ink to flow out, and a flow of the ink to the ejection port of the ejection port array becomes the flow in the same direction in all the ejection ports of the ejection port array, there is a problem that a size of the print element substrate is increased by the multiple arrays. That is, in the case where the number of ejection port arrays in which the flow is in the same direction in all the ejection ports is to be increased with the flow remaining in the same direction, the paths for supplying the ink/causing the ink to flow out also need to be provided with the number of ejection port arrays to be increased, whereby the size of the print element substrate increases and the size of the device increases.

SUMMARY OF THE INVENTION

Therefore, the present invention was made in view of the aforementioned problem and provides a print element substrate, a liquid ejection head, and a liquid ejecting device which enable multiple ejection-port array arrangement while suppressing an increase in the size of the print element substrate.

Thus, a print element substrate of the present invention includes: a plurality of ejection ports each for ejecting a liquid; a pressure generating element provided for each of the plurality of ejection ports and generating a pressure for ejecting the liquid from the ejection port; a first opening and a second opening provided by penetrating the substrate on which the pressure generating element is provided; a first channel provided corresponding to one of the ejection ports and communicating with the ejection port and the first opening; and a second channel provided corresponding to one of the ejection ports and communicating with the ejection port and the second opening, and the first channel and the second channel being provided with the ejection port therebetween, and the first channel, the second channel, and the ejection port corresponding to these channels being arranged between the first opening and the second opening, wherein the ejection ports with which the adjacent first channels or the adjacent second channels communicate, respectively, are arranged shifted from each other in a direction crossing a direction in which the first channels or the second channels are adjacent.

According to the present invention, it is possible to realize the print element substrate, the liquid ejection head, and the liquid ejecting device in which multiple ejection-port arrays are arranged with high density while suppressing an increase in size of the print element substrate.

Further features of the present invention will become apparent from the following description of exemplary embodiments with reference to the attached drawings.

DESCRIPTION OF THE EMBODIMENTS

First Embodiment

Figure 1:
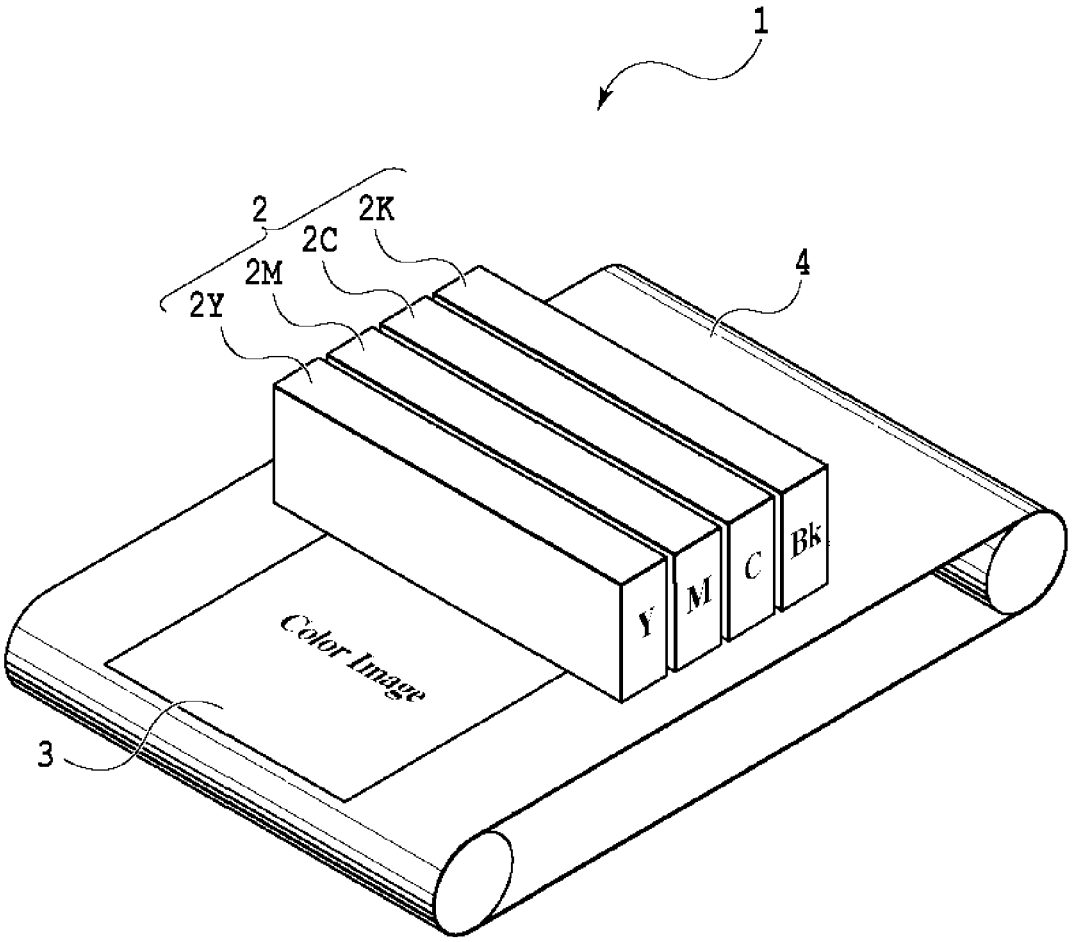
FIG. 1 is a perspective view illustrating an essential part of a liquid ejecting device.

FIG. 1 is a perspective view illustrating an essential part of a liquid ejecting device 1 to which a liquid ejection head of this embodiment can be applied (hereinafter also referred to simply as a printing device). The liquid ejecting device 1 is a full-line type printing device. That is, a liquid ejection head 2 is a head in which ejection ports are aligned with respect to a conveying direction of a print medium 3, corresponding to an entire print width. Liquid ejection heads 2Y, 2M, 2C, and 2K are provided so as to be aligned in the conveying direction for inks in yellow (Y), magenta (M), cyan (C), and black (K), respectively. Print is made on the print medium 3 by moving the print medium 3 by a conveying belt 4 with respect to these liquid ejection heads 2 and by ejecting a liquid (hereinafter also referred to as ink)

from the ejection port through each of the liquid ejection heads 2 in accordance with print data.

Figure 2:
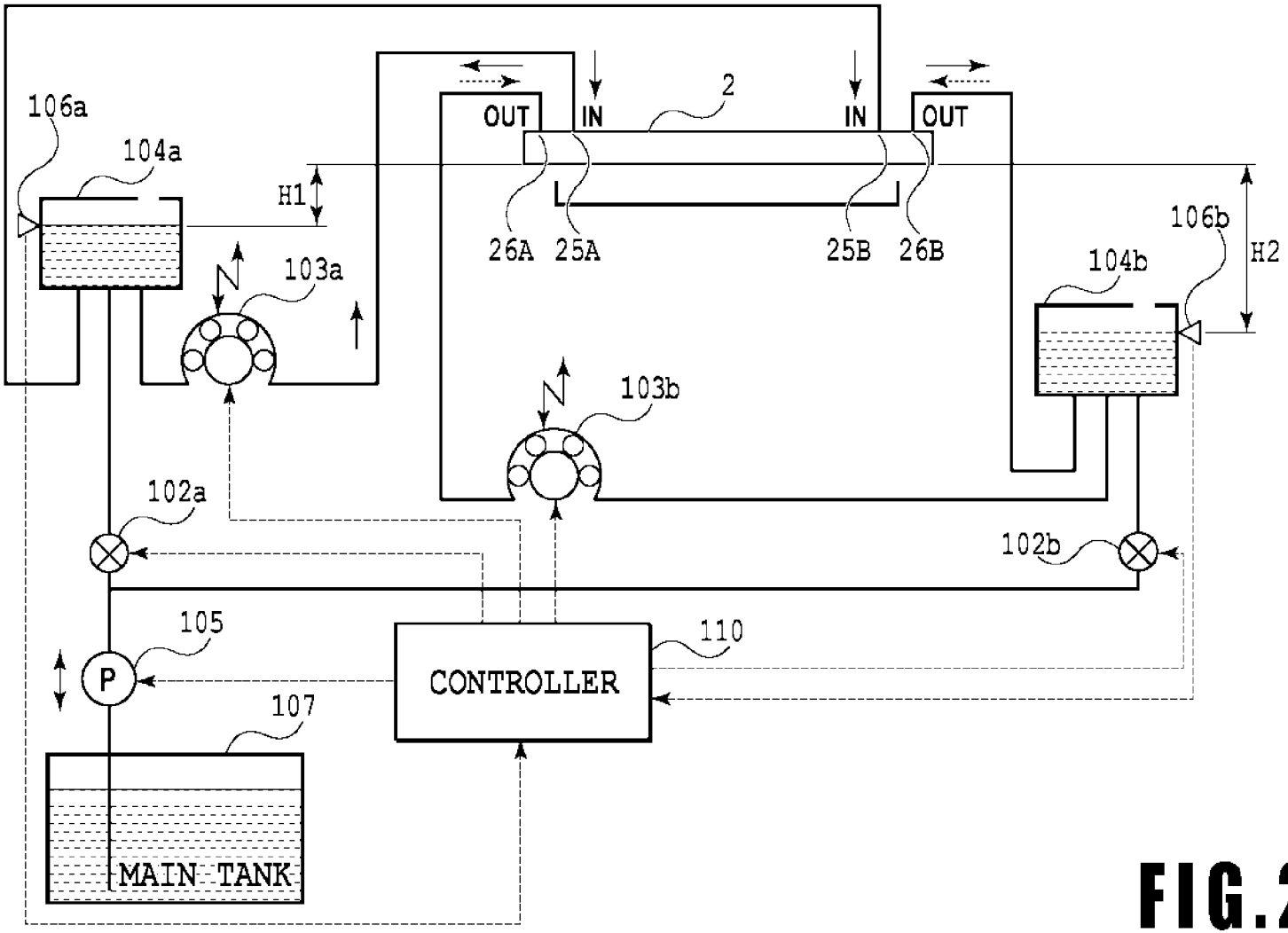
FIG. 2 is an explanatory view of an ink supply system of the liquid ejecting device connected to a liquid ejection head.

FIG. 2 is a view for explaining an ink circulation mechanism connected to the liquid ejection head 2 illustrated in FIG. 1. In the liquid ejection head 2, supply ports 25A and 25B and discharge ports 26A and 26B are provided. The supply port 25A is connected to a sub tank 104*a* through a tube pump 103*a*, and the supply port 25B is directly connected to the sub tank 104*a*. On the other hand, the discharge port 26A is connected to a sub tank 104*b* through a tube pump 103*b*, and the discharge port 26B is directly connected to the sub tank 104*b*. Moreover, a main tank 107 communicates with each of the sub tanks 104*a* and 104*b* through a pump 105. In a communication path between the main tank 107 and each of the sub tanks 104*a* and 104*b*, respective valves 102*a* and 102*b* are provided. Moreover, the sub tanks 104*a* and 104*b* include water-level sensors 106*a* and 106*b*, respectively.

A controller 110 can supply ink in the main tank 107 to the sub tanks 104*a* and 104*b* and can return the ink in the sub tanks 104*a* and 104*b* to the main tank 107 by controlling the pump 105 and the valves 102*a* and 102*b*. In more detail, the controller 110 controls the pump 105 and the valves 102*a* and 102*b* on the basis of a water level in each of the sub tanks detected by the water-level sensor and adjusts a position of a liquid level of the ink in each of the sub tanks 104*a* and 104*b*. As a result, a water head difference H1 in the ink between the liquid ejection head 2 and the sub tank 104*a* and a water head difference H2 in the ink between the liquid ejection head 2 and the sub tank 104*b* are maintained at predetermined sizes. Here, the water head difference H2 is a value larger than that of the water head difference H1 (H2>H1).

Under the aforementioned control, during a print operation (during ink ejection), the controller 110 brings the tube pumps 103*a* and 103*b* to an open state and allows the sub tank 104*a* and the supply port 25A and also the sub tank 104*b* and the discharge port 26A to communicate with each other. As a result, a relatively small negative pressure corresponding to the water head difference H1 acts on the ink supplied to the supply ports 25A and 25B, while a relatively large negative pressure corresponding to the water head difference H2 acts on the ink discharged from the discharge ports 26A and 26B. By means of a difference between these pressures, ink circulation entering in the liquid ejection head 2 from the supply ports 25A and 25B, flowing in one direction in each of pressure chambers as will be described later in FIG. 3A and the subsequent figures, and exiting out of the discharge ports 26A and 26B in the end can be generated.

A method of circulating the ink is not limited only to the method of using the water head difference as in this embodiment but the sub tanks 104*a* and 104*b* may be constituted as pressure chambers, for example, so that the aforementioned predetermined pressure difference is generated by adjusting the pressure of each of the pressure chambers.

Figure 3A:
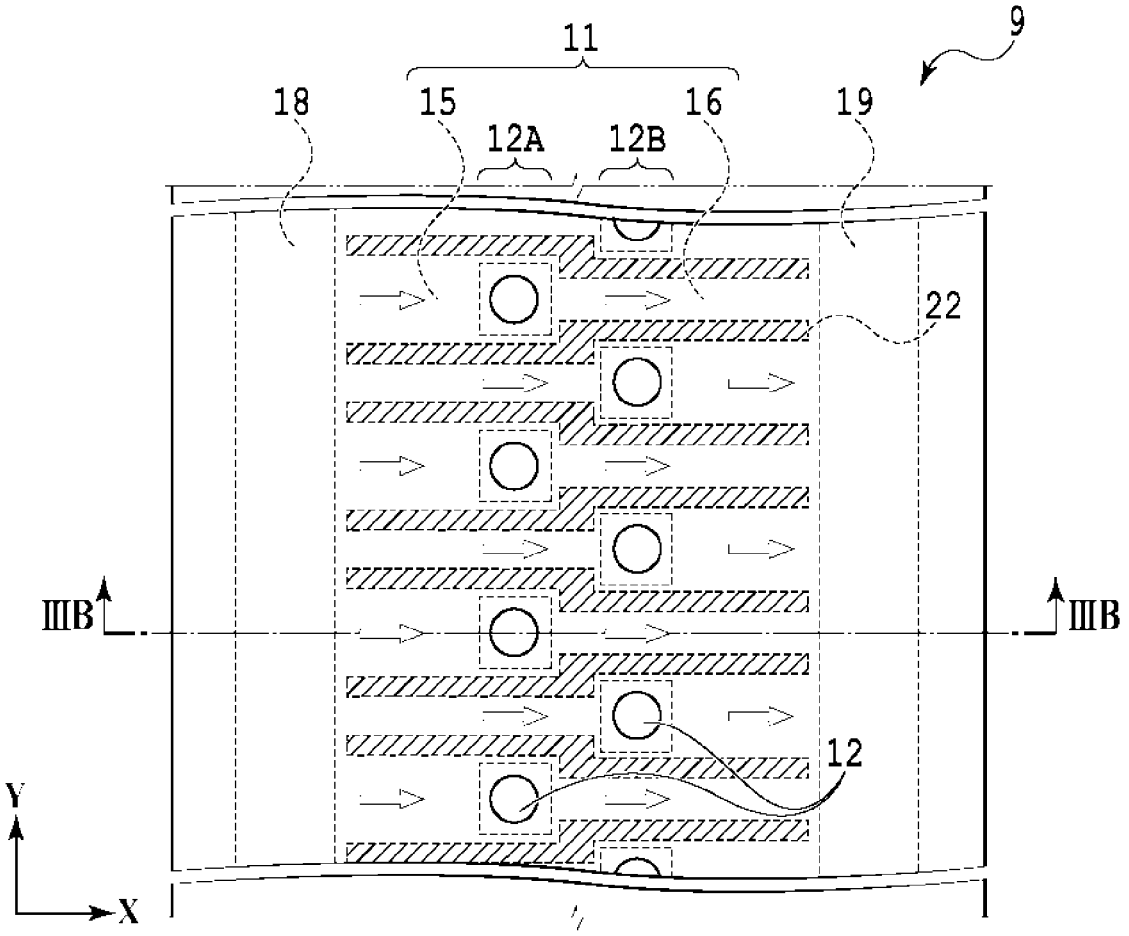
FIG. 3A is a view illustrating a print element substrate of a first embodiment.
Figure 3B:
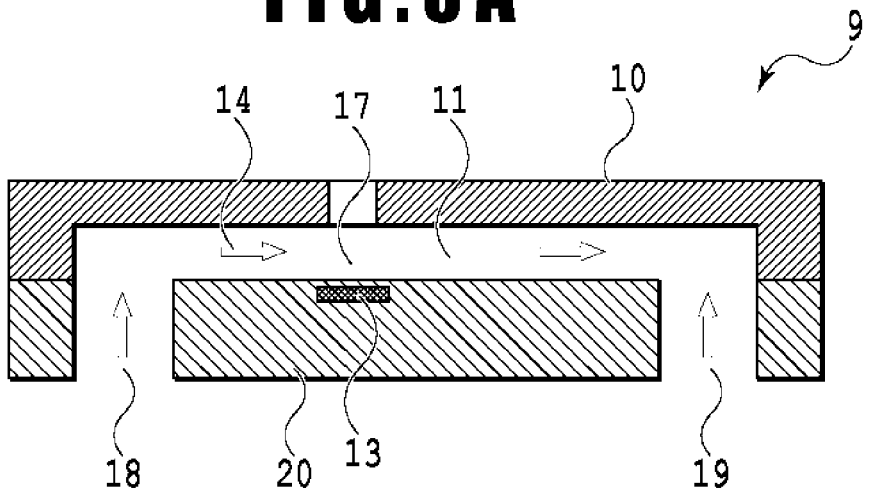
FIG. 3B is a view illustrating a section of the print element substrate of the first embodiment.

FIG. 3A is a view illustrating alignment of the ejection ports 12, the pressure generating elements 13 corresponding to them, and the like, in the print element substrate constituting the liquid ejection head 2 according to this embodiment, excluding a part of an ejection port forming member. FIG. 3B is a sectional view on a IIIB-IIIB line in FIG. 3A. As illustrated in this figure, the print element substrate is constituted by joining an ejection port forming member 10 and a substrate 20. Moreover, as illustrated in FIG. 3A, a plurality of the ejection ports 12 is provided so as to form predetermined alignment in the ejection port forming member 10.

In more detail, the plurality of ejection ports 12 has alignment formed of an ejection port array 12A aligned in an arrow Y direction (first direction) illustrated in FIG. 3A and an ejection port array 12B at the same alignment pitch as this ejection port array 12A. The ejection port array 12A and the ejection port array 12B are located shifted from each other in an arrow X direction (second direction) illustrated in FIG. 3A at a predetermined interval and they are also arranged in the arrow Y direction shifted by a half of each of the ejection-port alignment pitches.

In the ejection port forming member 10, a channel wall 22 is provided, and by being joined to the substrate 20, two channels 15 and 16 and a pressure chamber 17 communicating with these channels are formed for each of the plurality of ejection ports 12. The two channels 15 and 16 are also called a channel 11. The two channels 15 and 16 are juxtaposed by extending in the arrow X direction (second direction), and inside the pressure chamber 17, the pressure generating element 13 is provided. Moreover, the ejection port 12 is provided at a position facing the pressure generating element 13, whereby air bubbles are generated in the ink in the pressure chamber 17 by heat generated by the pressure generating element 13 in accordance with application of a voltage pulse, and the ink can be ejected by the pressure of the air bubbles from the ejection port 12.

In this embodiment, an ink circulation flow 14 in a constant direction is generated with respect to the pressure chamber 17 also at the time of print operation by the circulation mechanism described in FIG. 2. That is, it is constituted such that, after the ink having been supplied to the pressure chamber 17 is discharged to an outside of the pressure chamber 17, the ink can be supplied to the pressure chamber 17 again, that is, the ink is circulated between an inside of the pressure chamber 17 and the outside of the pressure chamber 17. Note that, in the pressure chamber 17 (ejection port 12) in which ink ejection is performed, a flow of the ink in a direction opposite to the aforementioned constant direction can be generated with the ink ejection, but in a case where an ejecting operation is not performed in the pressure chamber 17 after that, the flow returns to the circulation flow in the constant direction after some time has elapsed.

This circulation is a circulation in the arrow X direction in the ejection port alignment illustrated in FIG. 3A. Therefore, the channel 15 is also called an inflow path 15 through which the ink flows in toward the pressure chamber 17, and the channel 16 is also called an outflow path 16 through which the ink flows out from the pressure chamber 17. Moreover, in the substrate 20, an inflow port 18 and an outflow port 19 are formed by penetrating a front surface and a back surface thereof. The inflow port (opening) 18 communicates in common with the aligned plurality of inflow paths 15, while the outflow port 19 communicates in common with the aligned plurality of outflow paths 16. As a result, the inflow port 18 and the outflow port 19 are arranged with the ejection port array 12A and the ejection port array 12B therebetween.

The embodiment of the present invention reduces a size of the ejection port array in which the circulation in the same constant direction (the arrow X direction crossing the arrow Y direction) is present for the plurality of ejection ports (pressure chambers) aligned as above or particularly a size thereof in the alignment direction (the arrow Y direction) of the ejection ports. That is, in the alignment of the ejection port arrays in this embodiment, assuming that the ejection port array having the circulation in the same constant direction (the arrow X direction) for the plurality of ejection ports forms linear alignment, the positions of the adjacent ejection ports are shifted from each other in the constant direction (the arrow X direction) in this array. By means of this constitution, the ejection port arrays can be made multiple without newly providing an inflow port or an outflow port, and the size of the print element substrate can be reduced.

In specific constitution according to the aforementioned alignment, the inflow path 15 communicating with the ejection port array 12A at a position close to the inflow port 18 has a sectional area larger than that of the inflow path 15 communicating with the ejection port array 12B at a position far from the inflow port 18. Moreover, the outflow path 16 communicating with the ejection port array 12A at the position close to the inflow port 18 has a sectional area smaller than that of the outflow path 16 communicating with the ejection port array 12B at the position far from the inflow port 18.

Then, shapes of the inflow path 15 communicating with the ejection port array 12A at the position close to the inflow port 18 and the outflow path 16 communicating with the ejection port array 12B at the position close to the outflow port 19 are constituted substantially the same. Moreover, the shapes of the outflow path 16 communicating with the ejection port array 12A at the position close to the inflow port 18 and the inflow path 15 communicating with the ejection port array 12B at the position close to the outflow port 19 are constituted substantially the same.

As a result, flow resistances in the adjacent channels 11, that is, the channel 11 corresponding to the ejection port array 12A and the channel 11 corresponding to the ejection port array 12B can be made substantially equal, and in a case where a pressure difference is provided between the inflow port 18 and the outflow port 19, flow velocities in the adjacent channels 11 can be made substantially equal. As described above, since the ink flow velocities in the adjacent channels 11 are made substantially equal, a substantially equal ejection characteristic can be obtained at the ejection ports 12 in the adjacent channels 11.

Moreover, since the positions of the ejection ports 12 in the ejection port array 12A and the ejection port array 12B are shifted from each other by a half pitch in the alignment direction (the arrow Y direction) of the ejection ports 12, a size of the pressure chamber 17 can be increased as compared with constitution in which the ejection port array 12A and the ejection port array 12B are arranged in one array. Thus, a large ejection port or a large pressure generating element required for ejecting a larger amount of the ink can be arranged, and the liquid ejection head with a large ejection amount can be realized.

As described above, the ejection ports of the ejection port array 12A and the ejection ports of the ejection port array 12B with which the adjacent channels communicate, respectively, are arranged at positions shifted at a predetermined interval in the arrow X direction and at the positions shifted by a half of the respective ejection-port alignment pitches in the arrow Y direction, and each of the ejection ports includes an independent channel. Furthermore, the ejection port array 12A and the ejection port array 12B are provided between the inflow port 18 and the outflow port 19. As a result, the size of the print element substrate can be suppressed without adding the inflow port 18 or the outflow port 19, and a plurality of the ejection port arrays can be arranged with high density.

As described above, the print element substrate, the liquid ejection head, and the liquid ejecting device are realized in which the multiple ejection-port arrays are arranged with high density while the increase in the size of the print element substrate is suppressed.

Second Embodiment

A second embodiment of the present invention will be described below by referring to the attached drawings. Note that, since basic constitution of this embodiment is similar to that of the first embodiment, only characteristic constitution will be described below.

Figure 4A:
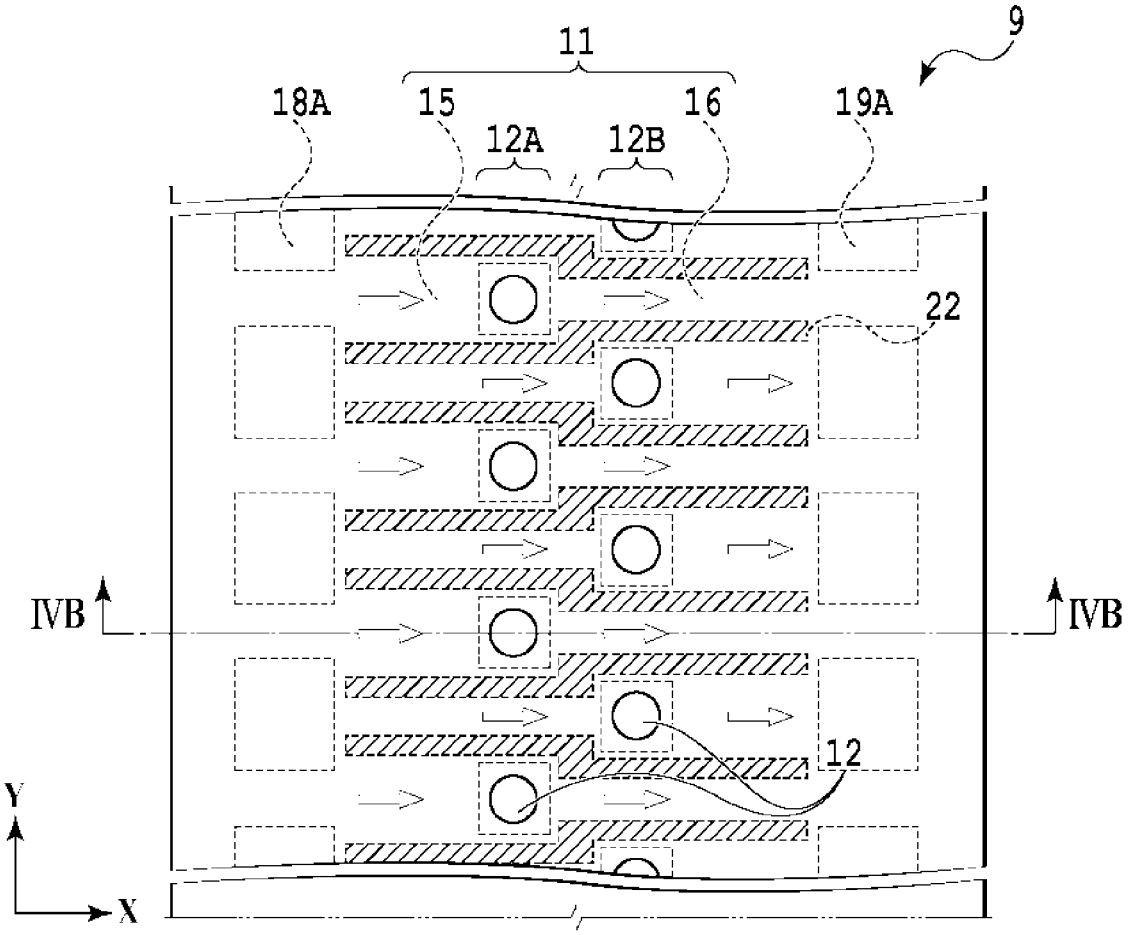
FIG. 4A is a view illustrating a print element substrate of a second embodiment.
Figure 4B:
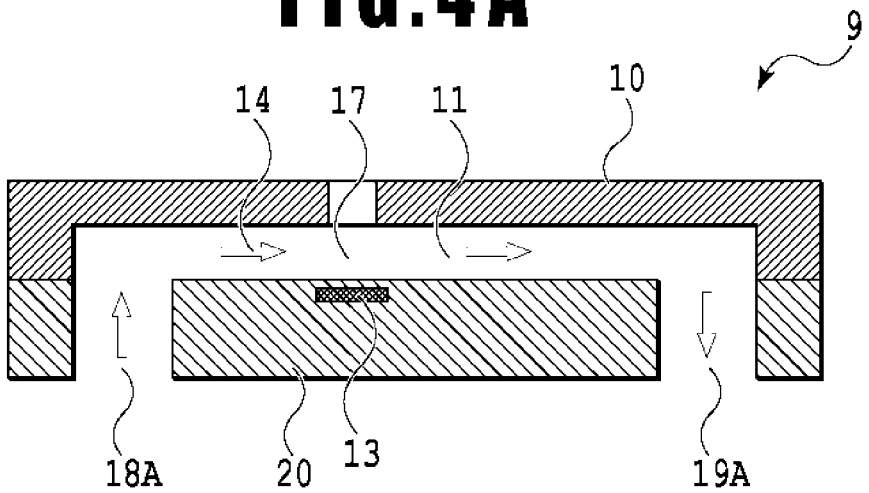
FIG. 4B is a view illustrating a section of the print element substrate of the second embodiment.

FIG. 4A is a view illustrating alignment of the ejection ports 12, the pressure generating elements 13 corresponding to them, and the like, in the print element substrate constituting the liquid ejection head 2 according to this embodiment, excluding a part of the ejection port forming member. FIG. 4B is a sectional view on a IVB-IVB line in FIG. 4A.

Constitution of the ejection port arrays 12A and 12B and the channel 11 in this embodiment is similar to that of the first embodiment. This embodiment and the first embodiment are different in constitution of the inflow port and the outflow port. An inflow port 18A and an outflow port 19A in this embodiment are constituted as in the figure such that each of a plurality of the inflow ports 18A and a plurality of the outflow ports 19A is arranged in one array along the ejection port arrays 12A and 12B. Here, although the inflow ports 18A and the outflow ports 19A are provided in plural, the individual inflow ports 18A and outflow ports 19A do not correspond to the individual channels. That is, the inflow ports 18A communicate in common with the aligned plurality of inflow paths 15, and the outflow ports 19A communicate in common with the aligned plurality of outflow paths 16. As described above, the constitution including the plurality of inflow ports 18A and the plurality of outflow ports 19A plays a role of a beam between the inflow ports 18A or between the outflow ports 19A, and thus, it is effective in improving strength of the substrate 20.

As described above, the ejection ports of the ejection port array 12A and the ejection ports of the ejection port array 12B with which the adjacent channels communicate, respectively, are arranged at positions shifted by a predetermined distance in the arrow X direction and at the positions shifted by a half of the respective ejection-port alignment pitches in the arrow Y direction, and each of the ejection ports includes an independent channel. Furthermore, the plurality of inflow ports 18A and the plurality of outflow ports 19A are arranged each in one array along the ejection port array. In this constitution, too, the print element substrate, the liquid ejection head, and the liquid ejecting device are realized, in which the multiple ejection-port arrays are arranged with high density while the increase in the size of the print element substrate is suppressed.

Third Embodiment

A third embodiment of the present invention will be described below by referring to the attached drawings. Note that, since basic constitution of this embodiment is similar to that of the first embodiment, only characteristic constitution will be described below.

Figure 5A:
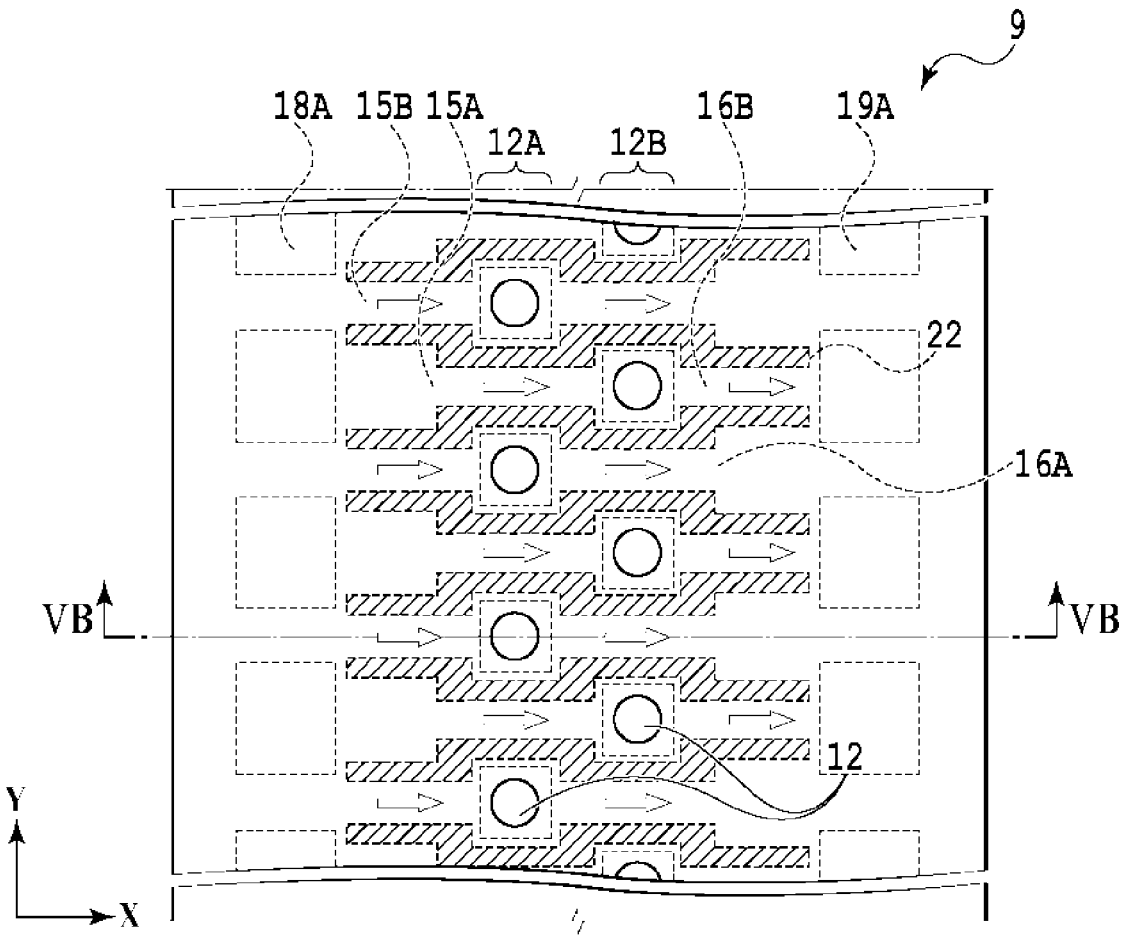
FIG. 5A is a view illustrating a print element substrate of a third embodiment.

FIG. 5A is a view illustrating alignment of the ejection ports 12, the pressure generating elements 13 corresponding to them, and the like, in the print element substrate constituting the liquid ejection head 2 according to this embodiment, excluding a part of the ejection port forming member.

Figure 5B:
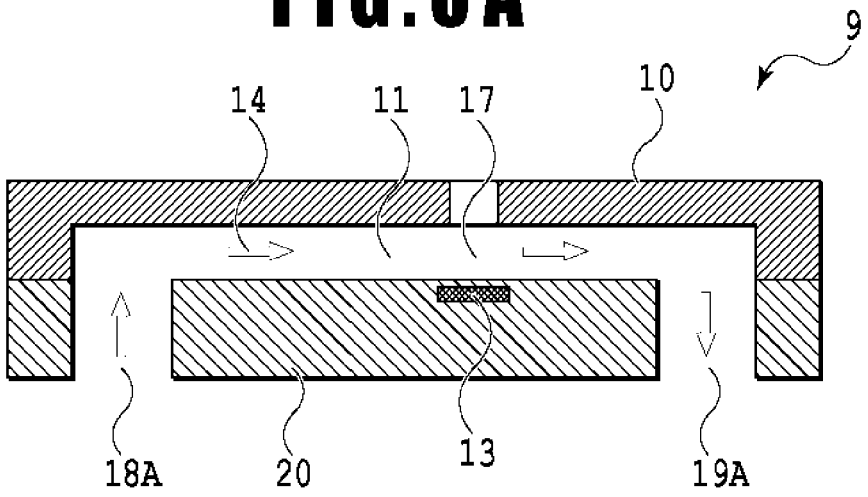
FIG. 5B is a view illustrating a section of the print element substrate of the third embodiment.

FIG. 5B is a sectional view on a VB-VB line in FIG. 5A. The constitution of this embodiment is different from the second embodiment in the constitution of the channel.

In this embodiment, similarly to the first and second embodiments, the independent channel 11 is provided at each of the ejection ports 12. Then, it is so constituted that widths of the channel and of a part of the channel adjacent to each other with the ejection port 12 therebetween are substantially the same.

Specifically, an inflow path 15B communicating with the ejection port array 12A at a position close to the inflow port 18A and an outflow path 16B communicating with the ejection port array 12B at a position far from the inflow port 18A are channels having substantially the same width, and they are channels each having a uniform width.

On the other hand, the outflow path 16A communicating with the ejection port array 12A at the position close to the inflow port 18A and the inflow path 15A communicating with the ejection port array 12B at the position far from the inflow port 18A are channels having two widths, respectively, different from each other. Further, a width of a channel with a small width which is a part of each of the inflow path 15A and the outflow path 16A is formed substantially the same as the width of each of the inflow path 15B and the outflow path 16B. Moreover, in both the paths, the inflow path (a part of the inflow path) through which the ink is made to flow into the ejection port 12 (pressure chamber 17) and the outflow path (a part of the outflow path) through which outflow of the ink from the ejection port 12 (pressure chamber 17) is introduced are channels having substantially the same width.

As described above, since the widths of the inflow path (a part of the inflow path) through which the ink is made to flow into the ejection port 12 (pressure chamber 17) and of the outflow path (a part of the outflow path) through which outflow of the ink from the ejection port 12 (pressure chamber 17) is introduced are made substantially the same, flow resistances before and after the ejection port 12 (pressure chamber 17) become equal. Thus, straightness of the ink ejected from the ejection port can be improved.

Moreover, in the circulation flow 14 flowing from the inflow port 18A to the outflow port 19A, a difference in the flow resistance between the inflow paths 15A and 15B with the respective ejection port array 12A at the position close to the inflow port 18A and ejection port array 12B at the far position becomes further smaller than that in the first and second embodiments. In a case where a pressure difference is provided between the inflow port 18 and the outflow port 19, the ink flow velocities in the adjacent channels 11 can be made substantially equal. Since the ink flow velocities in the adjacent channels 11 become substantially equal, the substantially equal ejection characteristics can be obtained in each of the ejection ports 12 in the adjacent channels 11.

Note that, in this embodiment, the outflow path 16A communicating with the ejection port array 12A at the position close to the inflow port 18A and the inflow path 15A communicating with the ejection port array 12B at the position far from the inflow port 18A are channels having two widths, respectively, different from each other, but this is not limiting. The constitution may have plural widths more than two as long as the inflow path (a part of the inflow path) through which the ink is made to flow into the ejection port 12 (pressure chamber 17) and the outflow path (a part of the outflow path) through which outflow of the ink from the ejection port 12 (pressure chamber 17) is introduced have substantially the same width.

As described above, the ejection ports of the ejection port array 12A and the ejection ports of the ejection port array 12B with which the adjacent channels communicate, respectively, are arranged at the positions shifted by the predetermined distance in the arrow X direction and also at the positions shifted by a half of the respective ejection-port alignment pitches in the arrow Y direction, and each of the ejection ports includes the independent channel. Moreover, the plurality of inflow ports 18A and the plurality of outflow ports 19A are provided with the ejection port array therebetween and are constituted such that the widths of the channels adjacent with the ejection port therebetween are substantially the same. As a result, the print element substrate, the liquid ejection head, and the liquid ejecting device which enable the multiple ejection-port array arrangement are realized while the increase in the size of the print element substrate is suppressed.

Fourth Embodiment

A fourth embodiment of the present invention will be described below by referring to the attached drawings. Note that, since basic constitution of this embodiment is similar to that of the first embodiment, only characteristic constitution will be described below.

Figure 6A:
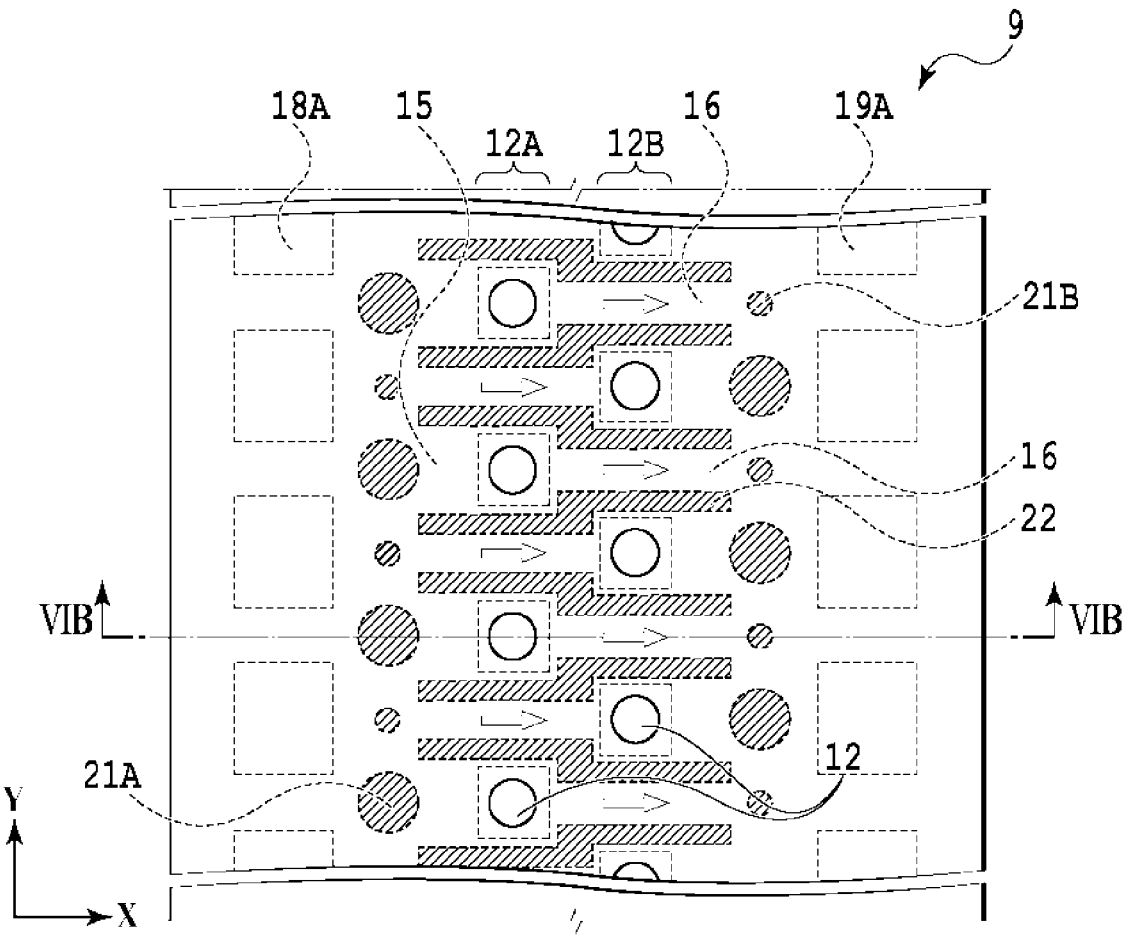
FIG. 6A is a view illustrating a print element substrate of a fourth embodiment.
Figure 6B:
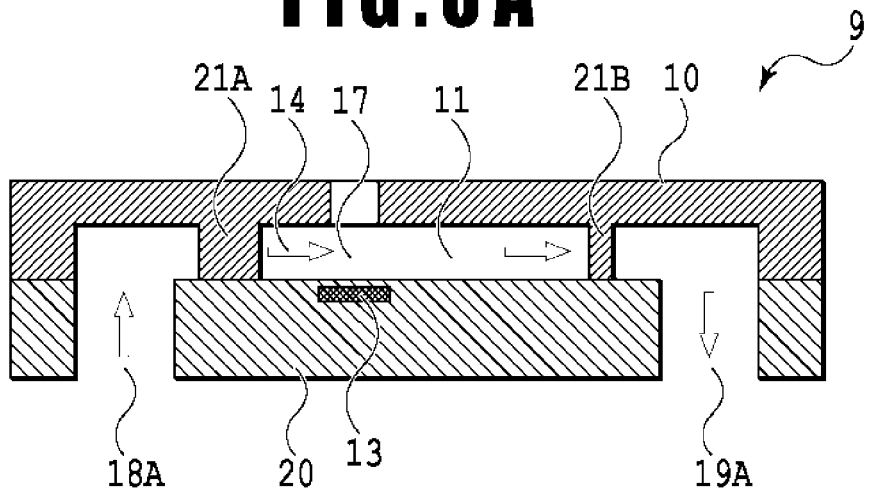
FIG. 6B is a view illustrating a section of the print element substrate of the fourth embodiment.

FIG. 6A is a view illustrating alignment of the ejection ports 12, the pressure generating elements 13 corresponding to them, and the like, in the print element substrate constituting the liquid ejection head 2 according to this embodiment, excluding a part of the ejection port forming member. FIG. 6B is a sectional view on a VIB-VIB line in FIG. 6A. In the constitution of this embodiment, the shape of the channel is similar to those of the first and second embodiments, but since this embodiment includes a filter, a length of the channel is shorter by that portion than those of the first and second embodiments.

In this embodiment, a columnar filter 21 is provided at an inflow portion of a channel between the inflow port 18A and the ejection port 12 (pressure chamber 17) and at an outflow portion of a channel between the outflow port 19A and the ejection port 12 (pressure chamber 17). The filter 21 has two kinds of filters, that is, a filter 21A having a large sectional area and a filter 21B having a small sectional area. The filter 21A having the large sectional area is provided in the inflow path and the outflow path with large widths, while the filter with the small sectional area is provided corresponding to the inflow path and the outflow path with small widths, respectively.

As described above, the flow resistances in the inflow path 15 and the outflow path 16 influencing the ejection characteristics can be made substantially equal by provision of the filters corresponding to the inflow path 15 and the outflow path 16 of each of the channels. Moreover, since the filter 21 is present in the inflow path 15, intrusion of a foreign substance contained in the circulation flow 14 into the channel can be prevented. As a result, non-ejection that the foreign substance clogs the channel and prevents ejection of the ink from the ejection port 12 can be suppressed.

As described above, the ejection ports of the ejection port array 12A and the ejection ports of the ejection port array 12B with which the adjacent channels communicate, respectively, are arranged at the positions shifted by the predetermined distance in the arrow X direction and also at the positions shifted by a half of the respective ejection-port alignment pitches in the arrow Y direction, and each of the ejection ports includes the independent channel. Moreover, the plurality of inflow ports 18A and the plurality of outflow ports 19A are provided with the ejection port array therebetween, and the filters corresponding to the inflow path 15 and the outflow path 16 of each of the channels are provided. As a result, the print element substrate, the liquid ejection head, and the liquid ejecting device which enable the multiple ejection-port array arrangement are realized while the increase in the size of the print element substrate is suppressed.

Fifth Embodiment

A fifth embodiment of the present invention will be described below by referring to the attached drawings. Note that, since basic constitution of this embodiment is similar to that of the first embodiment, only characteristic constitution will be described below.

Figure 7A:
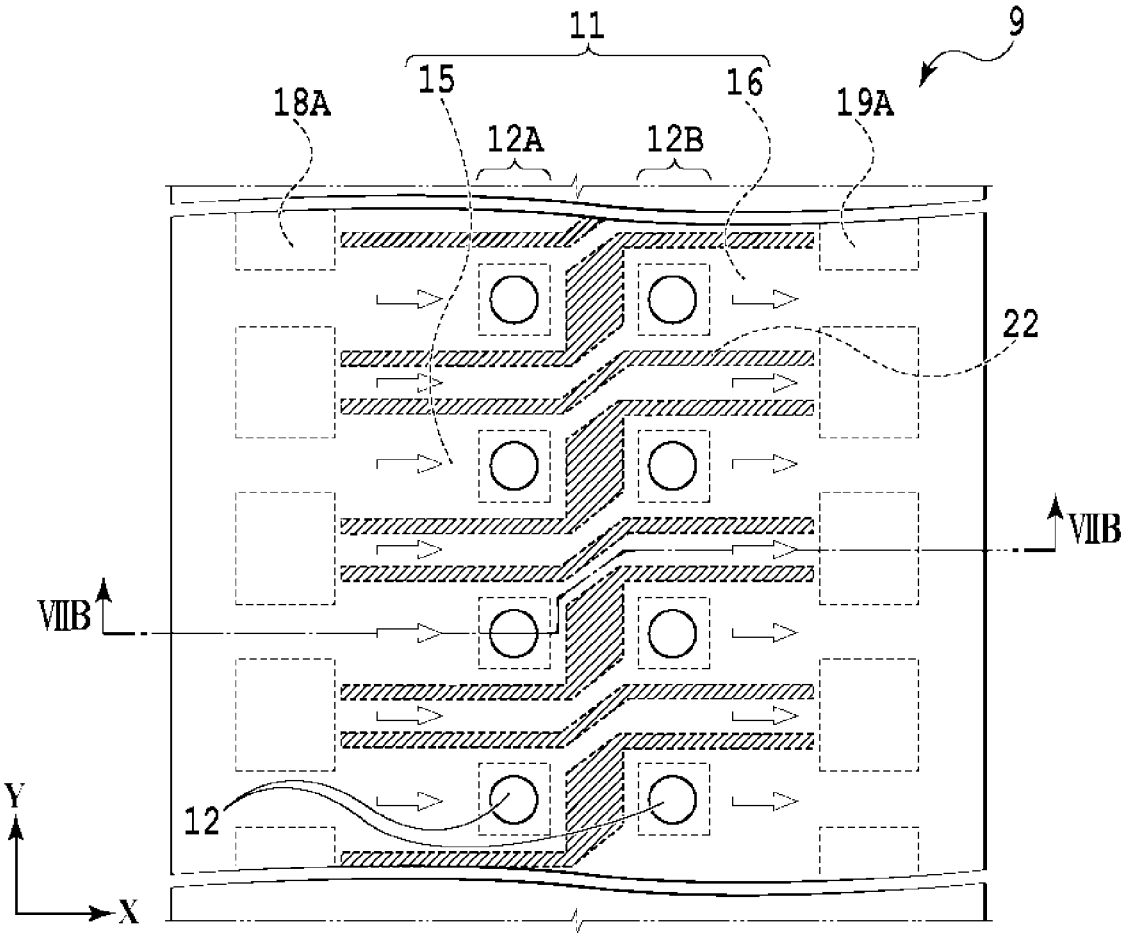
FIG. 7A is a view illustrating a print element substrate of a fifth embodiment.
Figure 7B:
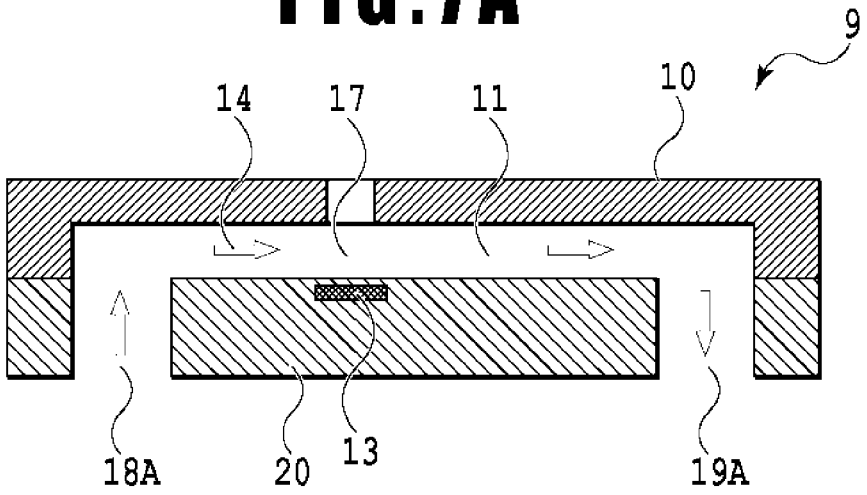
FIG. 7B is a view illustrating a section of the print element substrate of the fifth embodiment.

FIG. 7A is a view illustrating alignment of the ejection ports 12, the pressure generating elements 13 corresponding to them, and the like, in the print element substrate constituting the liquid ejection head 2 according to this embodiment, excluding a part of the ejection port forming member. FIG. 7B is a sectional view on a VIIB-VIIB line in FIG. 7A. In the ejection port forming member 10, the ejection port array 12A in which a plurality of circular ejection ports 12 is provided by forming an array and the ejection port array 12B provided at the same pitch as that of the ejection port array 12A and at the position shifted by the predetermined distance in the arrow X direction and also at the same positions in the arrow Y direction are provided. In each of the aforementioned embodiments, the flow of the ink in each of the channels forms a linear flow from the inflow port 18A to the outflow port 19A. However, in the channel of this embodiment, since the inflow path 15 and the outflow path 16 are provided at the positions shifted in the arrow Y direction, the flow of the ink is not linear, either, but is partially bent.

That is, the ink flows into the wide inflow path 15 toward the ejection port 12 (pressure chamber 17) of the ejection port array 12A close to the inflow port 18A and then, via the narrow outflow path 16 passing between the ejection ports 12 of the ejection port array 12B far from the inflow port 18A, it flows toward the outflow port 19A. Moreover, the flow of the ink having passed the narrow inflow path 15 passing between the ejection ports 12 of the ejection port array 12A close to the inflow port 18A flows toward the ejection port 12 (pressure chamber 17) of the ejection port array 12B far from the inflow port 18A after that and then, toward the outflow port 19A via the wide outflow path 16.

By means of the constitution as above, the alignment of the ejection ports can have higher density, and the increase in the size of the print element substrate can be further suppressed. Moreover, the flow resistances in the channel 11 corresponding to the ejection port array 12A and in the channel 11 corresponding to the ejection port array 12B can be made substantially equal.

Moreover, since the ejection ports are arranged by being aligned in the ejection port array direction (the arrow Y direction), wiring can be routed linearly, and thus, wiring for conducting a pressure converting element or wiring used for driving of a driving element for conducting the pressure converting element can be arranged easily in the constitution.

As described above, the ejection ports of the ejection port array 12A and the ejection ports of the ejection port array 12B with which the adjacent channels communicate, respectively, are arranged at positions shifted by the predetermined distance in the arrow X direction, and each of the ejection ports includes the independent channel. Moreover, the plurality of inflow ports 18A and the plurality of outflow ports 19A are provided with the ejection port array therebetween. As a result, the print element substrate, the liquid ejection head, and the liquid ejecting device which enable the multiple ejection-port array arrangement are realized while the increase in the size of the print element substrate is suppressed.

Another Embodiment

Figure 8A:
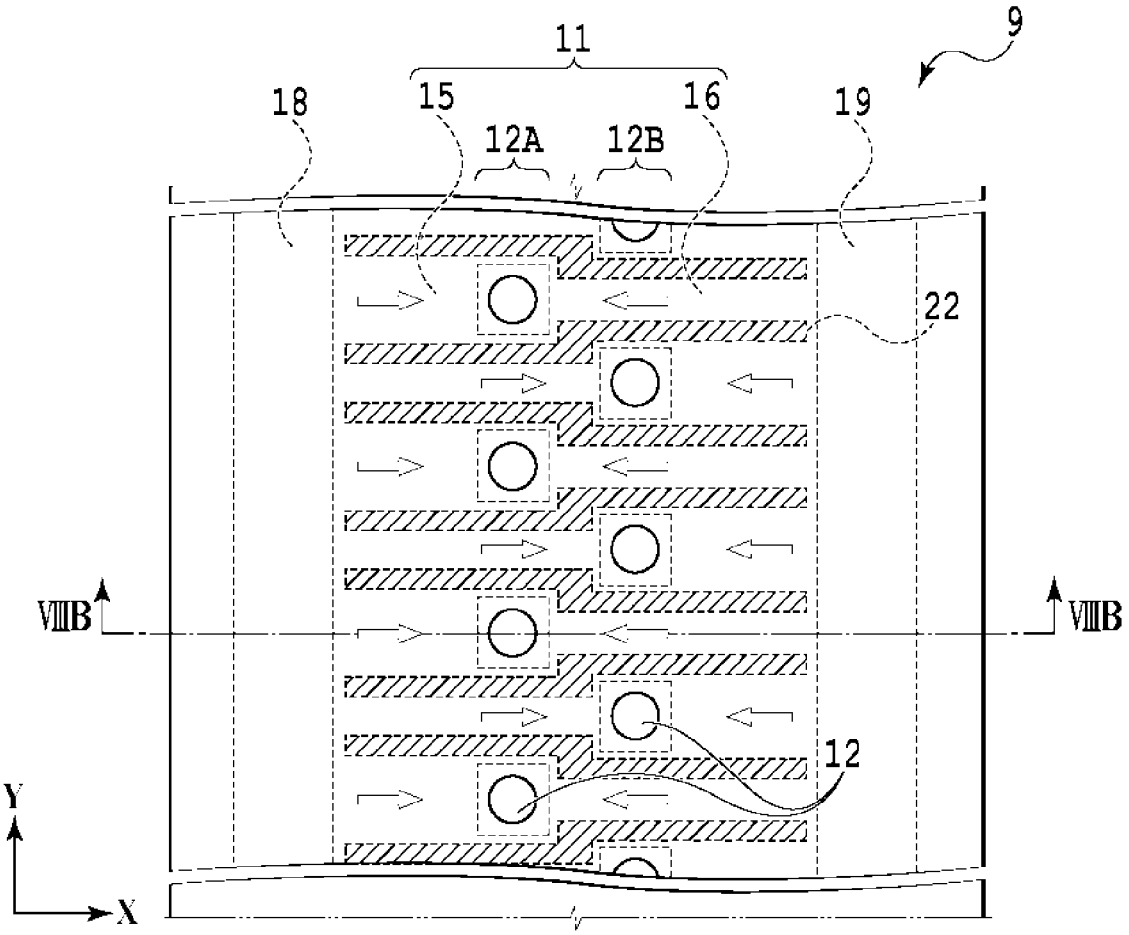
FIG. 8A is a view illustrating a print element substrate of another embodiment.
Figure 8B:
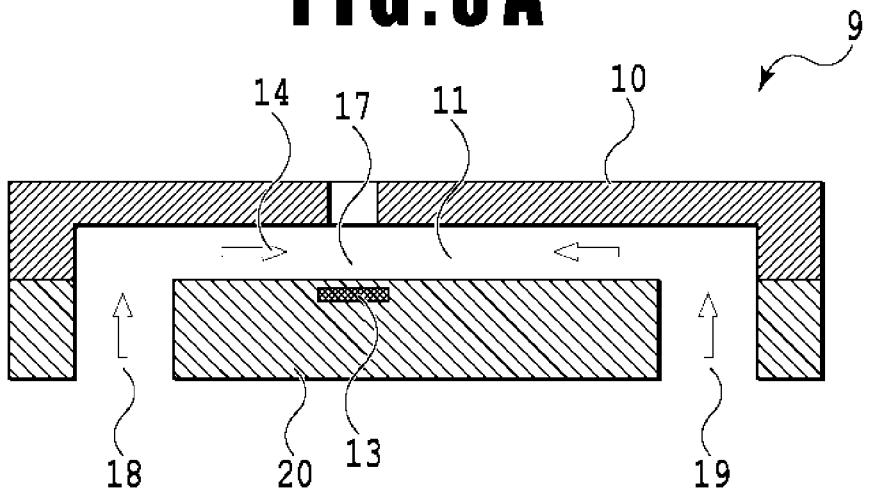
FIG. 8B is a view illustrating a section of the print element substrate of the another embodiment.

FIG. 8A is a view illustrating alignment of the ejection ports 12, the pressure generating elements 13 corresponding to them, and the like, in the print element substrate constituting the liquid ejection head 2 according to another embodiment, excluding a part of the ejection port forming member. FIG. 8B is a sectional view on a VIIIB-VIIIB line in FIG. 8A.

In each of the aforementioned embodiments, the constitution in which the ink flows in from the inflow port 18 and flows out of the outflow port 19 is described, but as another embodiment, constitution in which the ink flows in from both the inflow port 18 and the outflow port 19 and the ink having flowed in is ejected from the ejection port will be described.

The constitution of the print element substrate 9 in this embodiment is the same as the constitution of the print element substrate 9 of the first embodiment. In the first embodiment, the ink flows in from the inflow port 18 and flows out of the outflow port 19, but in this embodiment, the ink flows in from the inflow port 18 and also flows in from the outflow port 19. The ink having flowed in from the inflow port 18 and the outflow port 19 flows toward the pressure chamber 17 through the inflow path 15 and the outflow path 16 and is ejected from each of the ejection ports 12.

Here, the constitution of the print element substrate in the first embodiment is described as an example, but the similar ink flow can be realized also by the constitution of the print element substrate in each of the second to fifth embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030137 filed Feb. 19, 2016, which is hereby incorporated by reference wherein in its entirety.

What is claimed is:

1. A liquid ejection head comprising:

a first ejection port and a second ejection port disposed in a first direction for ejecting a liquid;

a first channel and a second channel extending in a second direction crossing the first direction and communicating with the first ejection port; and a third channel and a fourth channel extending in the second direction and communicating with the second ejection port, wherein the first ejection port and the second ejection port are arranged shifted in the second direction;

the first channel and the third channel are juxtaposed and the second channel and the fourth channel are juxtaposed; and a width of the first channel is smaller than a width of the third channel, and a width of the second channel is larger than a width of the fourth channel.

2. The liquid ejection head according to claim 1, wherein a first pressure generating element is provided at a position facing the first ejection port, and a second pressure generating element is provided at a position facing the second ejection port.

3. The liquid ejection head according to claim 2, further comprising a pressure chamber in which the first pressure generating element or the second pressure generating element is provided therein, wherein a liquid inside the pressure chamber is circulated between an inside of the pressure chamber and an outside of the pressure chamber.

4. The liquid ejection head according to claim 1, wherein a length of the first channel is longer than a length of the second channel, and a length of the third channel is shorter than a length of the fourth channel.

5. The liquid ejection head according to claim 1, further comprising a first opening communicating with the first channel and the third channel, and a second opening communicating with the second channel and the fourth channel, wherein the first ejection port, the second ejection port, the first channel, the second channel, the third channel, and the fourth channel are disposed between the first opening and the second opening.

6. The liquid ejection head according to claim 5, wherein a liquid flowing from the first opening passes through the first channel and the second channel and flows from the second opening, whereby the liquid is circulated between an inside of the liquid ejection head and an outside of the liquid ejection head.

* * * * *